US006337669B1

(12) United States Patent
Chiang

(10) Patent No.: US 6,337,669 B1
(45) Date of Patent: Jan. 8, 2002

(54) STRUCTURE OF MULTI-FREQUENCY ANTENNA FOR A MOBILE PHONE

(75) Inventor: Chi-Ming Chiang, Pa-Te (TW)

(73) Assignee: Auden Techno Corp. (TW)

( * ) Notice: Subject to any disclaimer, the term of this patent is extended or adjusted under 35 U.S.C. 154(b) by 0 days.

(21) Appl. No.: 09/624,552

(22) Filed: Jul. 24, 2000

(51) Int. Cl.[7] ..... H01Q 1/24
(52) U.S. Cl. ..... 343/895; 343/702
(58) Field of Search ..... 343/702, 895, 343/900, 715; H01Q 1/36, 1/24

(56) References Cited

U.S. PATENT DOCUMENTS 6,215,446 B1 * 4/2001 Sullivan et al. ..... 343/895
6,268,836 B1 * 7/2001 Faulkner et al. ..... 343/895

* cited by examiner

*Primary Examiner*—Michael C. Wimer
(74) *Attorney, Agent, or Firm*—Troxell Law Office PLLC

(57) ABSTRACT

An improved structure of a multi-frequency antenna for a mobile phone, the antenna is placed in an inner insulation sleeve to position a coil in cooperation with a receiving seat and is provided with a contact piece connected with one end thereof to the lower portion of the receiving seat and exposed partially to the outside; an outer sleeve is adapted for slipping over the inner insulation sleeve having been assembled with internal members, to make one end of the coil abut against the inner top surface of the outer sleeve, and the bottom end of the coil abut against the surface of the receiving seat; the coil includes in its length a sparse coil section and a dense coil section, the coil forms a multi-frequency antenna together with the receiving seat and the contact piece. The present invention can render manufacturing of multi-frequency antennae fast and convenient under the condition of using the improvement in the known antenna structure and known processing procedure of assembling.

7 Claims, 7 Drawing Sheets

STRUCTURE OF MULTI-FREQUENCY ANTENNA FOR A MOBILE PHONE

BACKGROUND OF THE INVENTION

1. Field of the Invention

The present invention is related to an improved structure of a multi-frequency antenna for a mobile phone, and especially to an antenna of which the novel designs of a coil and its related electric connecting elements make the antenna suit mobile phones of various frequencies under the situation of convenient manufacturing and assembling.

2. Description of the Prior Art

Antennae for mobile phones using only a single frequency (e.g. 900 MHZ) can suit two different frequencies (900 MHZ and 1800 MHZ) when it uses a frequency matching structure. While the antennas for mobile phones available presently sometimes use even higher frequencies, such as 1850 MHZ–1990 MHZ.

In such two-frequency antennas, generally coils of different diameters are used for matching, or metallic conductive pieces of in the shape of waveforms are used in lieu of coils, such as those shown in FIGS. 1 and 2. The metallic conductive piece 10 therein is pressing formed from thin metallic sheet, and includes generally a lateral vertical waveform section 11 and a horizontal waveform section 12. The metallic conductive piece 10 is a plane conductor with a specific width when it is pressing formed (as shown in FIG. 2), it can then be wrapped around the outer peripheral surface 14 of a post 13 of an antenna.

By virtue that the mutual contiguous lateral vertical waveform section 11 and horizontal waveform section 12 have to be used, the conventional two-frequency antenna structure is made from thin metallic sheet, thereby, precision die is required to pressing forming the whole metallic conductive piece, and this results higher cost. And the plane metallic thin sheet has to be wrapped around the post in processing; it is bothersome for manufacturing. And more, using of such a two-frequency antenna with large changing, the original production procedure must be changed, a new die has to be opened, working hour for manufacturing and assembling is increased, thereby, cost of production must be largely increased.

SUMMARY OF THE INVENTION

The object of the present invention is to provide a multi-frequency antenna for a mobile phone, and especially to a multi-frequency antenna rendering manufacturing and assembling thereof faster and more convenient for largely reducing cost of production must.

To get the above stated object, the present invention is provided with a coil which is dense and also sparse, the coil is positioned between the inner top surface of an outer sleeve and a receiving seat to form an electric conducting system for signal receiving and emitting of the antenna in cooperation with a contact piece. In the longitudinal length of the whole coil, spacing between every two rings of the coil is smaller, this is the dense section of the coil, while the remaining part is the sparse section; in this mode, the coil can be a multi-frequency sensing member after it is assembled.

The abovementioned dense section and sparse section have a ratio of length 1:2, the ratio of the spacing of their rings is 1:3.

The dense and sparse coil can be placed in the hollow interior of an inner insulation sleeve of the antenna, the bottom most ring of the coil is mounted in a metallic receiving seat in a bottom hole of the inner insulation sleeve, the topmost ring thereof is abutted against the inner top surface of the outer sleeve slipping over the inner insulation sleeve. In cooperation with an elastic contact piece mounted on the bottom of the inner insulation sleeve, the coil can be assembled in a mobile phone and used as the signal receiving and emitting antenna device.

The present invention will be apparent in its novelty and other characteristics after reading the detailed description of the preferred embodiment thereof in reference to the accompanying drawings.

DETAILED DESCRIPTION OF THE PREFERRED EMBODIMENT

Figure 1:
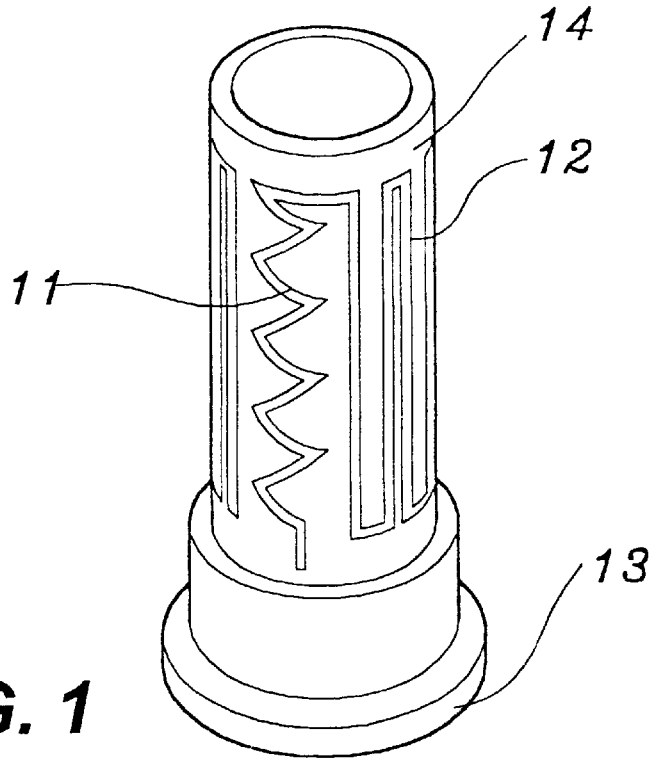
FIG. 1 PRIOR ART
FIG. 1 is a perspective view showing a conventional two-frequency antenna.
Figure 2:
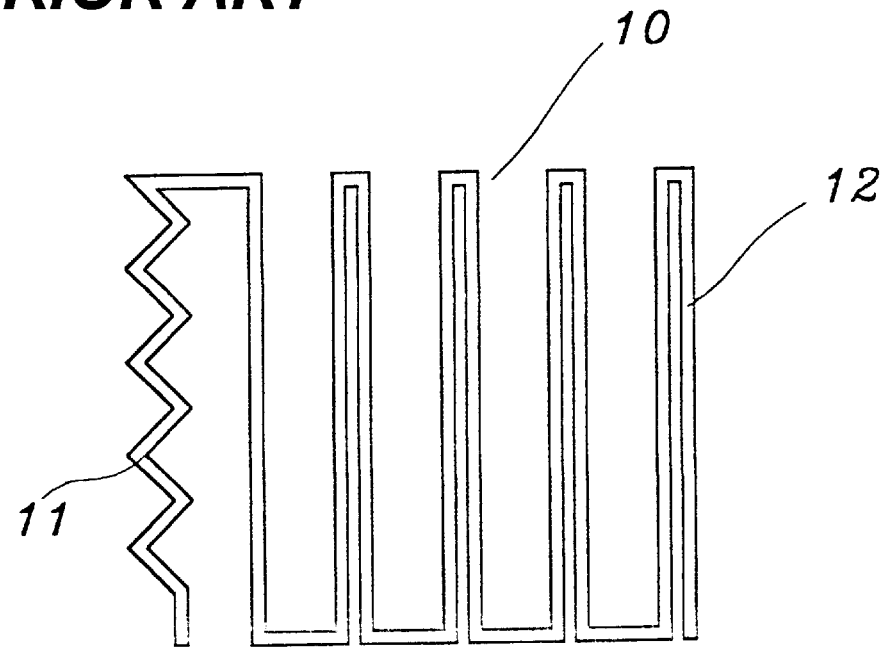
FIG. 2 PRIOR ART
FIG. 2 is a plane view showing spreading out of a conductive piece in FIG. 1.
Figure 3:
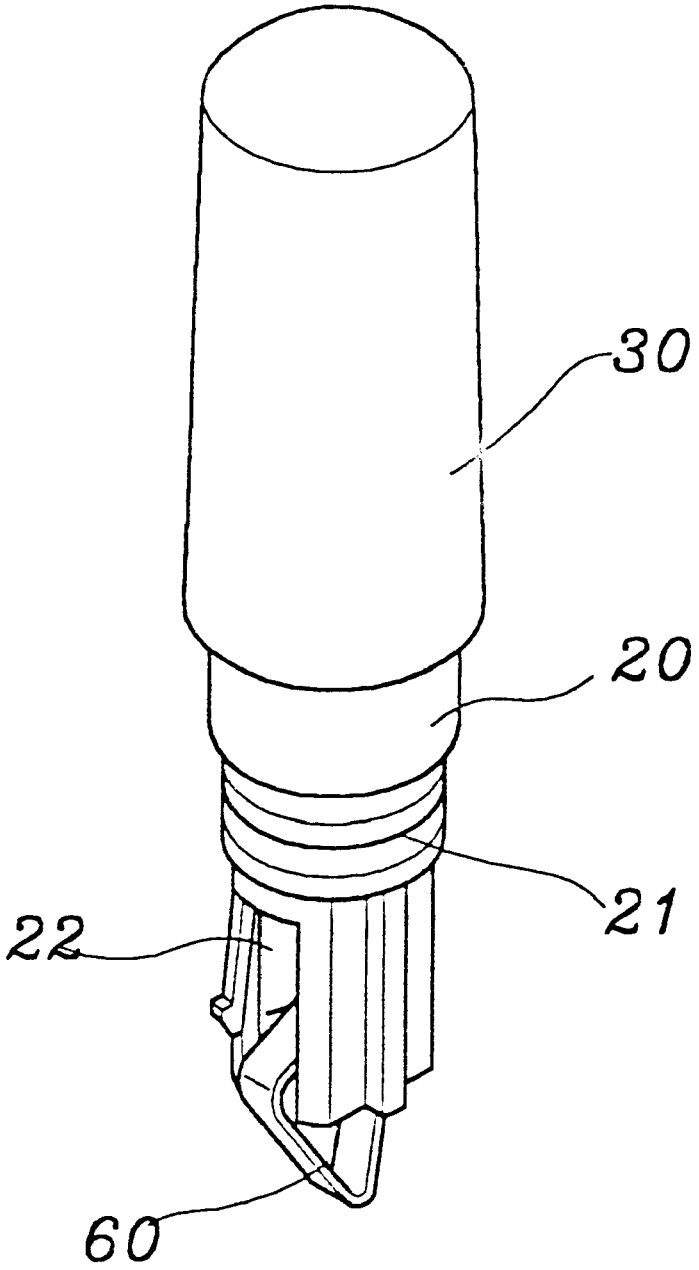
FIG. 3 is a perspective view showing a preferred embodiment of the present invention.

Referring to FIGS. 3–6 in the first place which shows a miniature fixed type antenna for a mobile phone as an example, the antenna is comprised mainly of an inner insulation sleeve 20, an outer sleeve 30 able to slip over the inner insulation sleeve 20, a receiving seat 40 and a coil 50 between the two sleeves and an exposed contact piece 60. In this preferred embodiment which is convenient for explanation, the coil 50 is matched with the related electric connecting elements such as the receiving seat 40 and the exposed contact piece 60 and is used as an electric conducting system for signal receiving and emitting of the antenna. In other embodiments however, it can also be connected singly with a receiving seat provided with a threaded connecting end to form the electric conducting system for signal receiving and emitting of the antenna.

The inner insulation sleeve 20 is provided near the bottom end thereof with a threaded connecting section 21 and a slot 22 on one side of and below the threaded connecting section 21 for mounting a conductive member or contact piece 60, the contact piece 60 is elastic and is partially exposed after mounting. The inner insulation sleeve 20 is provided with a hole 23 having a larger diameter opened to the top thereof and with a hole 24 having a smaller diameter opened to the bottom thereof, and a shoulder 25 is formed between the two holes.

The receiving seat 40 can be placed in the hole 23 (having the larger diameter) of the inner insulation sleeve 20 to be abutted against the shoulder 25, and is provided on the upper surface thereof with a receiving disk 41 with a suitable diameter, and further is provided on the lower surface thereof with a guiding post 42. The receiving disk 41 can be abutted against one end of the coil 50, and the lower guiding post 42 can be extended into the hole 24 having the smaller diameter to cooperatively press and position the upper end of the contact piece 60.

The assembled structure of the inner insulation sleeve 20 and the internal members has the same operation procedure as that for assembling such miniature fixed antennae. The inner insulation sleeve 20 of the assembled internal members then can be slipped in the outer sleeve 30 having an inner top surface 34 and a down facing inner hole 32, the outer sleeve 30 can be slipped over the most part of the external peripheral surface of the inner insulation sleeve 20, and keeps the threaded connecting section 21 of the inner insulation sleeve 20 and the contact piece 60 exposed ready for connecting. After the inner insulation sleeve 20 and the outer sleeve 30 are slipped one over the other, a joint area 33 between them can be fixedly sealed with adhesive or by some melting connection method which is discovered recently. Under the state of combination of the two sleeves, the upper end of the coil 50 is abutted against the inner top surface 34 of the outer sleeve 30, and the bottom end of the coil 50 is abutted against the receiving disk 41.

Figure 4:
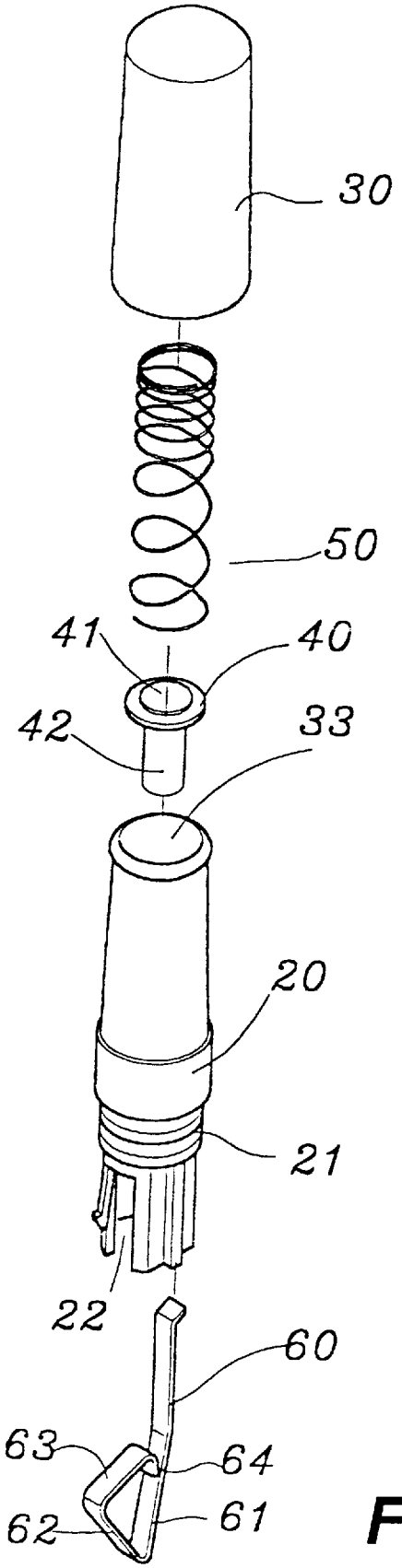
FIG. 4 is an analytic perspective view of the elements shown in FIG. 3.
Figure 5:
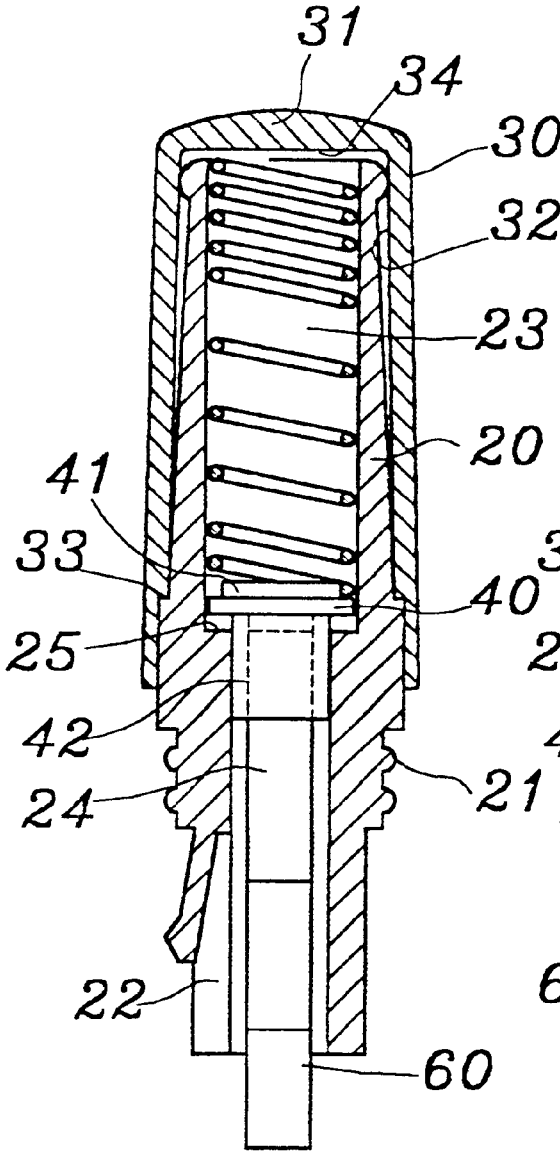
FIG. 5 is sectional view taken from FIG. 4.
Figure 6:
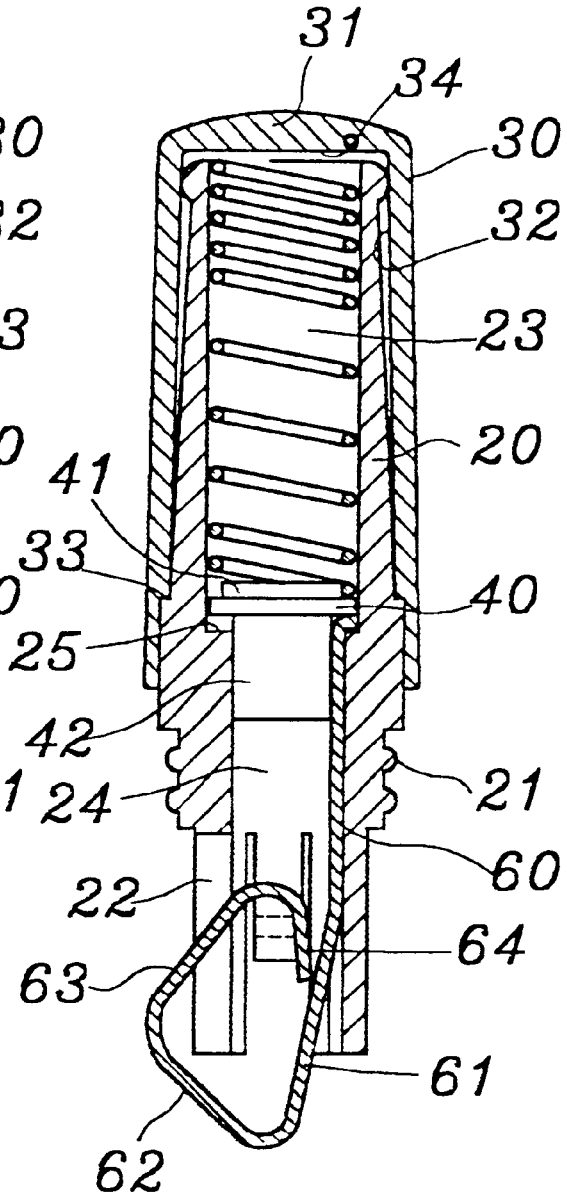
FIG. 6 is another sectional view taken from FIG. 4.

The contact piece 60 is extended for a preset vertical length in the embodiment shown in order to match and press for contacting with the coil 50. As shown in FIGS. 4 and 6, the bottom end of the vertical section tilts slightly (about 20 degrees relative to the vertical section) to form a first bending section 61; then the bottom end of the first bending section 61 is bent backwardly to form a second bending section 62 which is in the direction about 50 degrees relative to the first bending section 61; thereafter, the second bending section 62 is bent to form a third bending section 63 which is in the direction about 100 degrees relative to the second bending section 62; lastly, the third bending section 63 is bent backwardly to form a fourth bending section 64 which is abutted on the first bending section 61.

Figure 7:
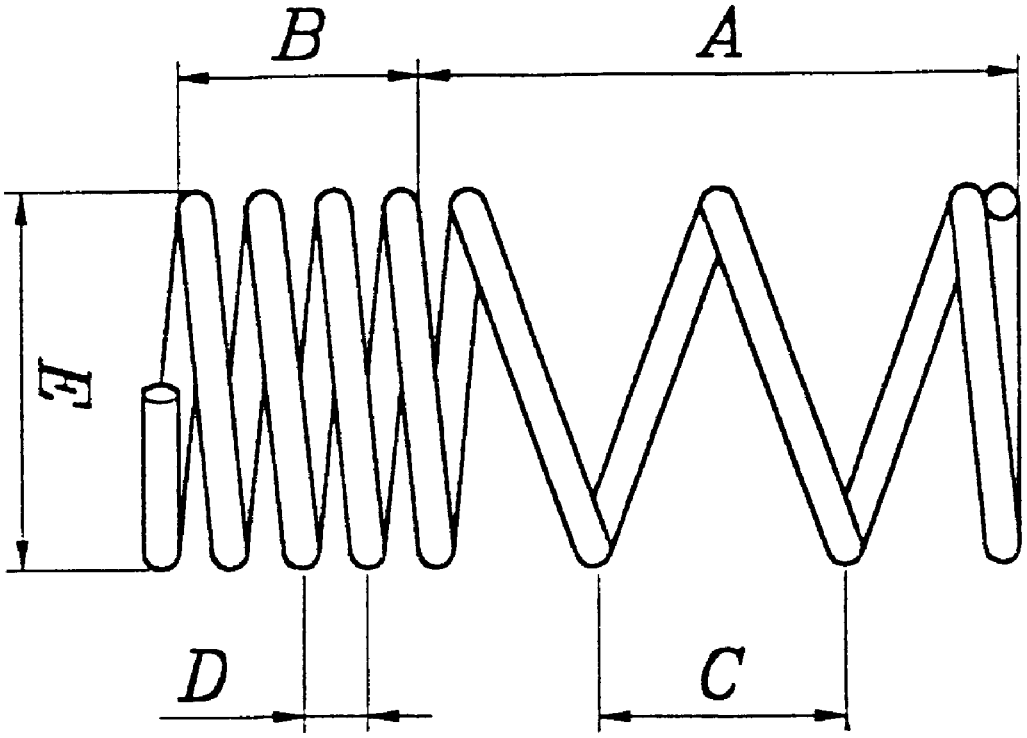
FIG. 7 is an enlarged plane view of a coil of the present invention.

Referring to FIG. 7, the coil 50 includes in its length a sparse coil section A and a dense coil section B, the length of the sparse coil section A is about twice the length of the dense coil section B in this preferred embodiment. The spacing C between every two rings of the sparse coil section A is about thrice the length of the spacing D of the dense coil section B. In other words, if the length of a coil (i.e., A+B) of such kind used generally is 16.2 mm, when the diameter E of the rings is 5.3 mm, the diameter of the wire of the coil is 0.6 mm, then the length of A is 10.8 mm, and the length of B is 5.4 mm. In the embodiment shown, the spacing C between every two rings of the sparse coil section A is about 4.3 mm, while the spacing D between every two rings of the dense coil section B is about 1.25 mm. The sizes and ratios stated above are only for illustration of the preferred embodiment. When the coil is used in a miniature fixed antenna of a different brand and style, the sparse coil section can obtain its ideal size and ratio in the test in the primary assembling.

Figure 8:
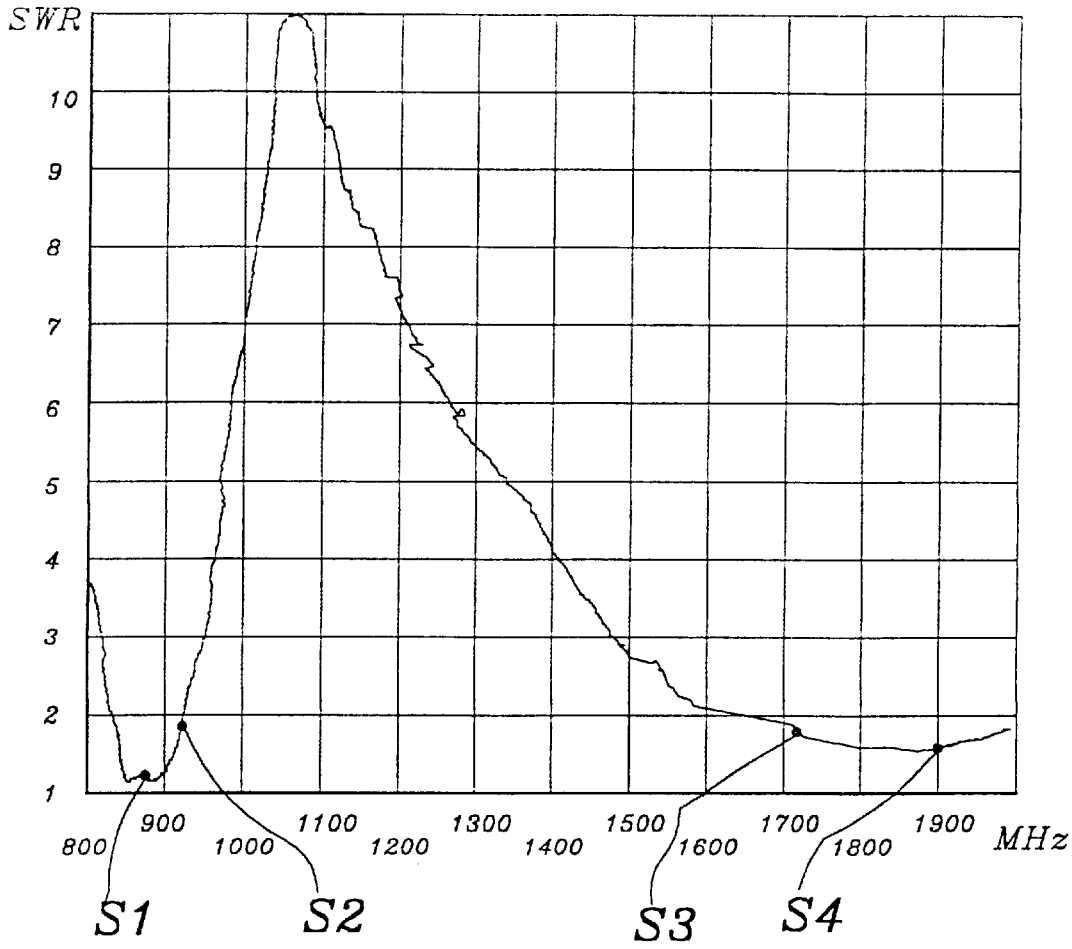
FIG. 8 is a test chart for the coil of FIG. 7.
Figure 9:
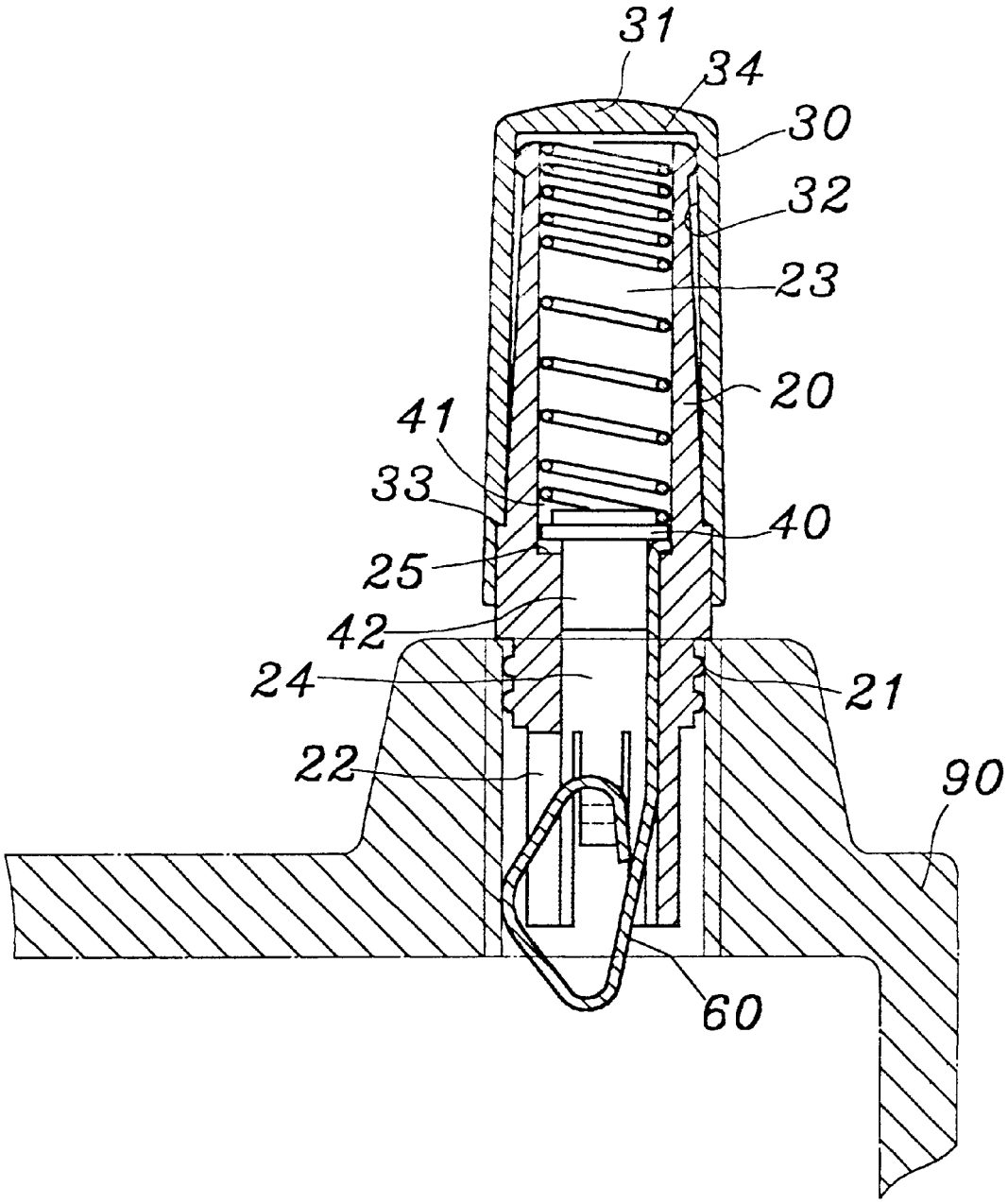
FIG. 9 is a schematic view showing assembling of the present invention on a mobile phone.

FIG. 8 shows a test chart for the abovementioned coil 50. In the chart, the ordinate shows standing wave ratio (SWR), while the abscissa shows frequency (MHZ). The above stated antenna structure is used for testing, in the test chart, four test points $S_1$, $S_2$, $S_3$, $S_4$ are respectively located as below: $S_1$ is located between 890–915 MHZ, $S_2$ is located between 935–960 MHZ, $S_3$ is located between 1710–1785 MHZ, while $S_4$ is located between 1805–1880 MHZ; their standing wave ratios are all below 2, in this case, they are functionally quite ideal. Thereby, the present invention can have an extreme ideal multi-frequency antenna for the mobile phone 90 as shown in FIG. 9 not only suiting 900–1800 MHZ, but also suiting 1850–1990 MHZ.

In conclusion, the present invention can render manufacturing of multi-frequency antennas fast and convenient under the condition of using the improvement in the known antenna structure and known processing procedure of assembling. It makes cost of production lowered, and suits mass production in a factory; thereby it is industrial valuable.

Having now particularly described and ascertained the nature of our said invention and in what manner the same is to be performed, we declare that what we claim are:

1. An improved structure for a multi-frequency antenna for a mobile phone, wherein said antenna is placed in an inner insulation sleeve to position a coil in cooperation with a receiving seat and is provided with an elastic conductive member connected with one end thereof to a lower portion of said receiving seat and exposed partially to the outside; an outer sleeve is slipped over said inner insulation sleeve, said outer sleeve having internal elements including said receiving seat, said coil and said elastic conductive member, such that one end of said coil abuts against an inner top surface of said outer sleeve, and a bottom end of said coil abuts against a surface of said receiving seat; said coil including along a length thereof, a sparse coil section and a dense coil section, such that said coil forms a multi-frequency antenna together with said receiving seat and said elastic conductive member.

2. The improved structure for a multi-frequency antenna for a mobile phone as defined in claim 1, wherein said dense coil section and said sparse coil section have a ratio of length of 1:2.

3. The improved structure for a multi-frequency antenna for a mobile phone as defined in claim 1, wherein the ratio of the spacing of rings on said dense coil section and said sparse coil section is 1:3.

4. The improved structure for a multi-frequency antenna for a mobile phone as defined in claim 1, wherein said conductive member is an elastic contact piece, one end of said elastic contact piece being positioned by a bottom surface of said receiving seat and having an exposed bottom end.

5. The improved structure for a multi-frequency antenna for a mobile phone as defined in claim 4, wherein said elastic contact piece is extended to form a vertical section, said exposed bottom being on an end of said vertical section and tilted to form a first bending section; then a bottom end of said first bending section is bent backwardly to form a second bending section; thereafter, said second bending section is bent to form a third bending section which is in the direction a large angle relative to said second bending section, said third bending section bent backwardly to abut on said first bending section.

6. The improved structure for a multi-frequency antenna for a mobile phone as defined in claim 1, wherein said exposed elastic conductive member projects from a threaded connecting section below said receiving seat.

7. The improved structure for a multi-frequency antenna for a mobile phone as defined in claim 2, wherein the ratio of the spacing of rings on said dense coil section and said sparse coil section is 1:3.

* * * * *